United States Patent [19]

Jacobs et al.

[11] Patent Number: 4,488,737

[45] Date of Patent: Dec. 18, 1984

[54] COMBINED KEY HOLDER AND BOOKLET

[75] Inventors: Anthony S. Jacobs, Glencoe; James E. Riley, Deerfield; Jon D. Christman, Northbrook, all of Ill.

[73] Assignee: The Wessel Company, Inc., Elk Grove Village, Ill.

[21] Appl. No.: 398,099

[22] Filed: Jul. 14, 1982

Related U.S. Application Data

[63] Continuation-in-part of Ser. No. 294,453, Aug. 20, 1981.

[51] Int. Cl.[3] ..... B42D 3/00

[52] U.S. Cl. ..... 281/31; 283/23

[58] Field of Search ..... 40/359; 150/39; 206/447, 459, 460, 807; 229/72; 281/16, 31, 38; 282/25; 283/23, 56, 42

[56] References Cited

U.S. PATENT DOCUMENTS

| | | | |
|---|---|---|---|
| 324,584 | 8/1885 | Payne | 283/42 |
| 1,017,006 | 2/1912 | Lee | 281/31 X |
| 2,982,322 | 5/1961 | Seitz | D3/56 X |
| 3,086,694 | 4/1963 | Tucker et al. | D3/56 X |
| 3,446,260 | 5/1969 | Osher | 150/39 |
| 3,734,396 | 5/1973 | Cowan | 283/23 X |
| 3,941,309 | 3/1976 | Gendron | 282/25 X |
| 3,970,332 | 7/1976 | Alford, Jr. | 283/56 X |
| 3,979,051 | 9/1976 | Close | 229/72 |

FOREIGN PATENT DOCUMENTS

| | | | |
|---|---|---|---|
| 1279118 | 11/1961 | France | 281/31 |

OTHER PUBLICATIONS

TWA Airline Ticket Holder 12-1975.

1973 Article with "London Bound!" on the inside of the front cover.

1976 Article with "Important Information" on a pocket located at the inside of the front cover.

*Primary Examiner*—Paul A. Bell

*Attorney, Agent, or Firm*—Marshall, O'Toole, Gerstein, Murray & Bicknell

[57] ABSTRACT

A combined key holder and booklet comprising front and back covers enclosing a plurality of booklet pages. The front cover and a pocket member peripherally attached to the front cover define a pocket into which a key may be inserted through a lateral slot in the front cover. The longitudinal and lateral dimensions of the components are controlled to provide specified relationships. A detachable envelope is optional as part of the booklet.

10 Claims, 8 Drawing Figures

COMBINED KEY HOLDER AND BOOKLET

RELATED APPLICATION

This is a continuation-in-part of application Ser. No. 294,453 filed Aug. 20, 1981 and entitled "Combined Airline Ticket Holder And Advertising Booklet", the disclosure of which is incorporated herein by reference.

BACKGROUND OF THE INVENTION

The present invention relates generally to booklets and more particularly to a combined hotel room key holder and booklet containing hotel information and advertising of goods and services.

A guest checking into a hotel is provided with a key and oftentimes is also provided with printed matter containing information on the hotel's facilities and services. When the hotel guest is provided with a separate key and separate printed matter, this gives him two separate, discreet objects to hold onto and keep track of, and this can sometimes be inconvenient. Recently, for security purposes, the hotel key does not have imprinted the hotel room number thereon, but, rather, the room number is written on a separate sheet of paper given to the hotel guest, and this constitutes another item which the guest must keep track of.

Hotel guests include a large percentage of business travelers, and these constitute a disproportionate number of persons whose income level is substantially higher than average and who include the pacesetters and trendsetters in the acquisition of goods and services. Because of the demographics relating to these hotel guests, as a group they represent an unusually desirable category to whom goods and services should be advertised.

SUMMARY OF THE INVENTION

In accordance with the present invention there is combined in one article of manufacture, structure for holding a hotel key, writing space for imprinting the room number where security considerations make it undesirable to put the room number on the hotel key, and a booklet which may contain information about the hotel's facilities and services, together with page space for advertising goods and services of a number of additional businesses.

Generally, the article comprises a pair of covers joined together along a junction. Located between the covers, and attached to a cover is a booklet comprising a plurality of pages. Attached to one of the covers is a pocket for holding an object such as a hotel room key, and communicating with the interior of the pocket is a lateral slit in that cover. The key is inserted into the pocket through the slit.

As an option, the booklet may include a detachable envelope connected to one of the booklet pages which, in turn, forms a part of the envelope. This envelope may be used for transmitting comments to the hotel management or as a return mailer for ordering one of the goods or services advertised in the booklet.

In combining a booklet with a key holder in a single article of the type described above, there are a number of structural considerations which should be taken into account. For economy of manufacture, the longitudinal dimensions of both covers, of the booklet pages, of the pocket and of the envelope should be the same. In addition, the lateral dimension of each cover, and of the pocket should be constant along the entire length thereof.

To facilitate thumbing readily of either of the covers without obstruction by the booklet or by the other cover, the lateral dimensions of the covers and of the booklet pages should be controlled, in a manner to be subsequently described in detail.

Other features and advantages are inherent in the structure claimed and disclosed or will become apparent to those skilled in the art from the following detailed description in conjunction with the accompanying diagrammatic drawings.

DETAILED DESCRIPTION

Figure 1:
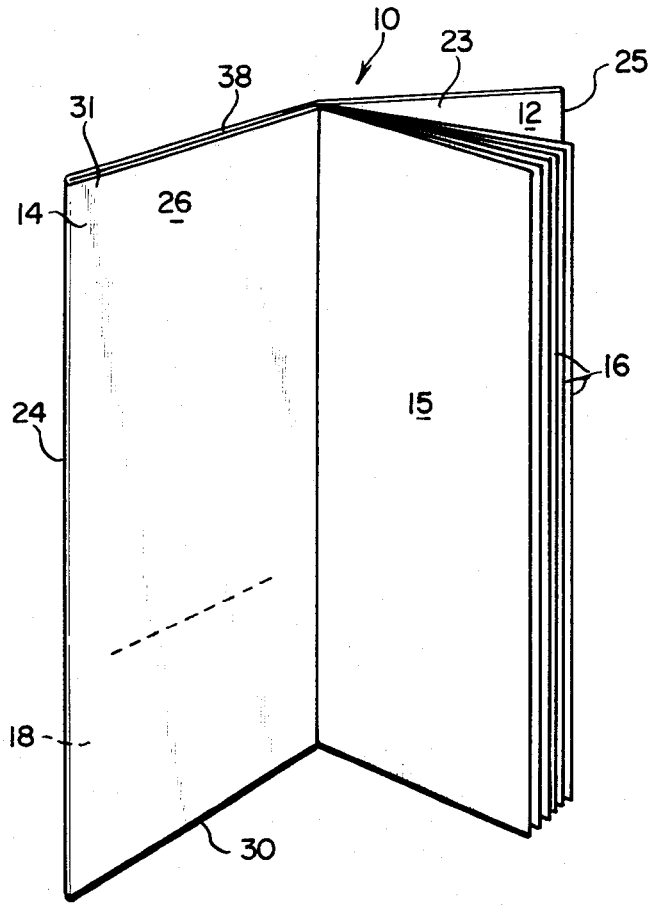
FIG. 1 is a perspective illustrating a combined key holder and booklet in accordance with an embodiment of the present invention and showing the article in an open condition.

Referring initially to FIGS. 1-5, indicated generally at 10 is an article of manufacture consituting a combined key holder and booklet constructed in accordance with an embodiment of the present invention. Article 10 has a size which enables it to be conveniently inserted into and carried within the lapel pocket of a suitcoat. Article 10 is typically composed of paper and comprises a planar front cover 11 joined to a planar back cover 12 along a junction or fold 13. Located between front and back covers 11, 12 and attached to front cover 11 is a pocket member 14 which together with front cover 11 defines a pocket 18 for receiving and holding a hotel room key insertable into pocket 18 through a lateral slit 40 in front cover 11. Typically, such a key is swingably linked to a grab element which would hang from slit 40 over front cover 11 when the key is in the pocket. Covers 11, 12 and pocket member 18 constitute the holder-part of the article.

Figure 5:
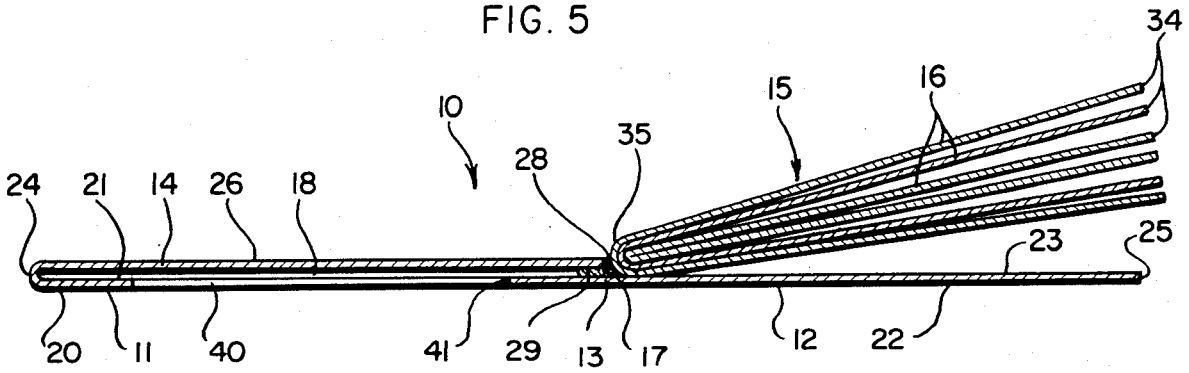
FIG. 5 is a sectional view taken along line 5—5 in FIG. 4, with the booklet pages in a partially open condition.

Located between covers 11, 12 is a booklet 15 comprising a plurality of pages 16, 16 (FIG. 5). Booklet 15 is attached to the holder adjacent the interior of junction 13.

Figure 6:
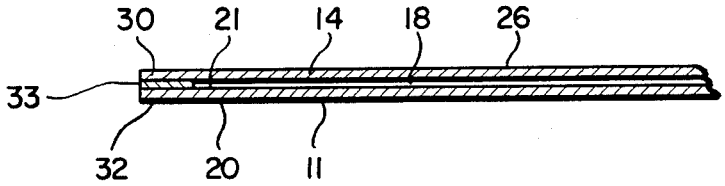
FIG. 6 is a fragmentary sectional view taken along line 6—6 in FIG. 5.

Front cover 11 is elongated and has an outer surface 20 and an inner surface 21 (FIG. 6). Back cover 12 is also elongated and has an outer surface 22 and an inner surface 23 (FIG. 5). Front cover 11 and back cover 12 have respective first or outside longitudinal edge portions 24, 25, and a mutual second or inside longitudinal edge portion at fold 13.

Figure 4:
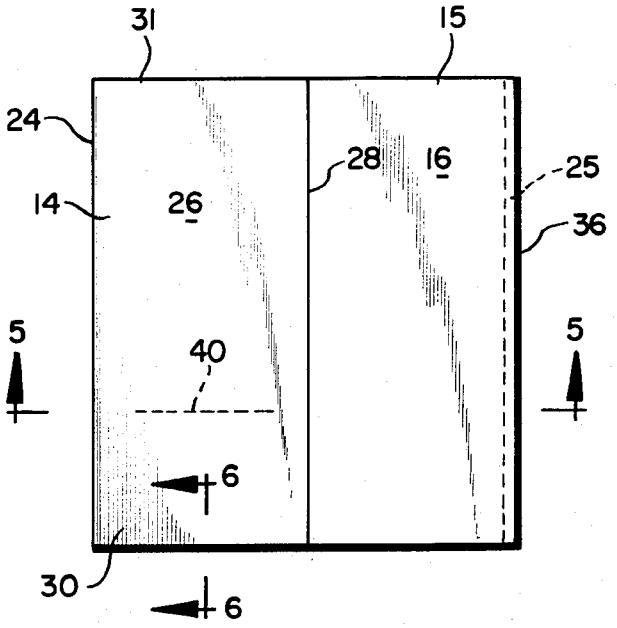
FIG. 4 is a plan view of the combined holder and booklet, viewed from the inside, with the article in an open condition.

Pocket member 14 is disposed along the inner surface 21 of front cover 11 and is joined to the front cover along the latter's first longitudinal edge portion 24. Pocket member 14 has an inner longitudinal edge portion 28 attached to front cover inner surface 21 adjacent fold 13 by a longitudinally extending adhesive strip 29 (FIG. 5). As shown in FIG. 5, adhesive strip 29 extends longitudinally between lateral edge portions 30 and 31 at least as far as slit 40. Pocket member 14 and front cover 11 have respective corresponding first lateral edge portions 30, 32 secured together along a laterally extending adhesive strip 33 (FIG. 6). The pocket member and front cover also have respective second lateral edge portions 31, 38 (FIG. 1) which may be secured by an adhesive strip or remain unsecured. As shown in FIGS. 1 and 4, slit 40 is closer to secured first lateral edge portions 30, 32 than to second lateral edge portions 31, 38.

Figure 3:
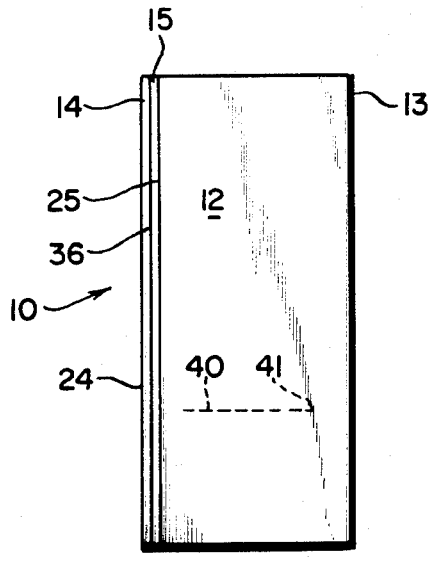
FIG. 3 is a rear view of the combined holder and booklet.

Booklet 15 is located between pocket member 14 and the inner surface 23 of back cover 12. As noted above, booklet 15 has a plurality of pages 16, 16, and each of these pages contains information or advertising matter printed thereon. Each page 16 has a first or outer longitudinal edge portion 34 and an inner or second longitudinal edge portion joined with the other inner longitudinal edge portions of the pages to define an inner longitudinal edge portion 35 of the booklet. The first or outer longitudinal edge portions 34, 34 of the pages are unjoined, and the laterally outermost of longitudinal edge portions 34, 34 defines the outer longitudinal edge portion 36 of the booklet (FIGS. 3–4). In the illustrated embodiment, all of the page edge portions 34, 34 extend laterally outwardly an equal amount.

The booklet's inner longitudinal edge portion 35 is joined by a longitudinally extending adhesive strip 17 to back cover 12 adjacent fold 13. The inner longitudinal edge portions of pages 16, 16 are joined together at 35 by adhesive means (not shown).

In the illustrated embodiments, pocket member 14 is attached to front cover 11 and booklet 15 is attached to back cover 12 at junction 13.

As is best shown in FIG. 3, the lateral dimension of back cover 12, which terminates at outer longitudinal edge portion 25, is less than the lateral dimension of booklet 15 terminating at outer longitudinal edge portion 36, and the lateral dimension of booklet 15 is less than the lateral dimension of front cover 11, which terminates at outer longitudinal edge portion 24. The result of these lateral dimensional relationships is to facilitate thumbing of either of the covers without obstruction by the other of the covers or by the booklet and to facilitate thumbing of the booklet without obstruction by either of the covers.

The longitudinal dimensions of both covers 11, 12, of pocket member 14 and of booklet 15 are all the same. The lateral dimension of each cover, of the pocket member and of each page in the booklet is constant along the entire length thereof. These dimensional characteristics facilitate economical manufacture of the combined key holder and booklet by minimizing die cutting of the article's components.

In the illustrated embodiment, the lateral dimension of pocket member 14 is substantially the same as that of front cover 11, although it need not be. The lateral dimension of pocket member 14 is determined by the space requirements of pocket 18 and the dimensional requirements of slit 40.

Figure 2:
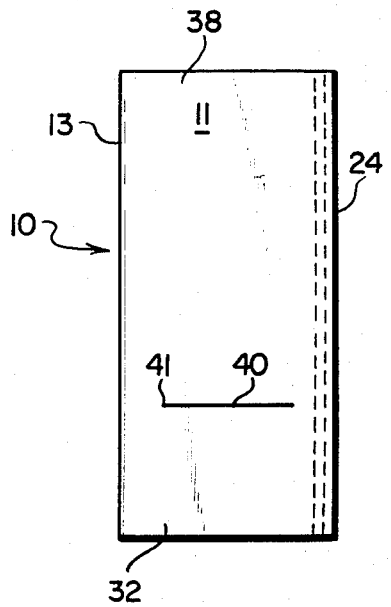
FIG. 2 is a front view of the combined holder and booklet.

Slit 40 is located in front cover 11 behind pocket member 14 and is disposed between the front cover's first longitudinal edge portion 24 and fold 13. The slit terminates at an inner end 41 spaced from fold 13 (FIGS. 2–3). Slit 40 comprises means for permitting the insertion of a key into pocket 18 from the outside of front cover 11.

Information and/or advertising may be imprinted upon each of the pages 16, 16 in booklet 15 and on the outer and inner surfaces 22, 23 of back cover 12 and on the inner surface 26 of pocket member 14. Preferably, outer surface 20 of front cover 11 is left blank, or the information and/or advertising printed thereon is minimized, so that space is available on front cover outer surface 20 to imprint the room number for the key inserted in pocket 18 of the holder.

Figure 7:
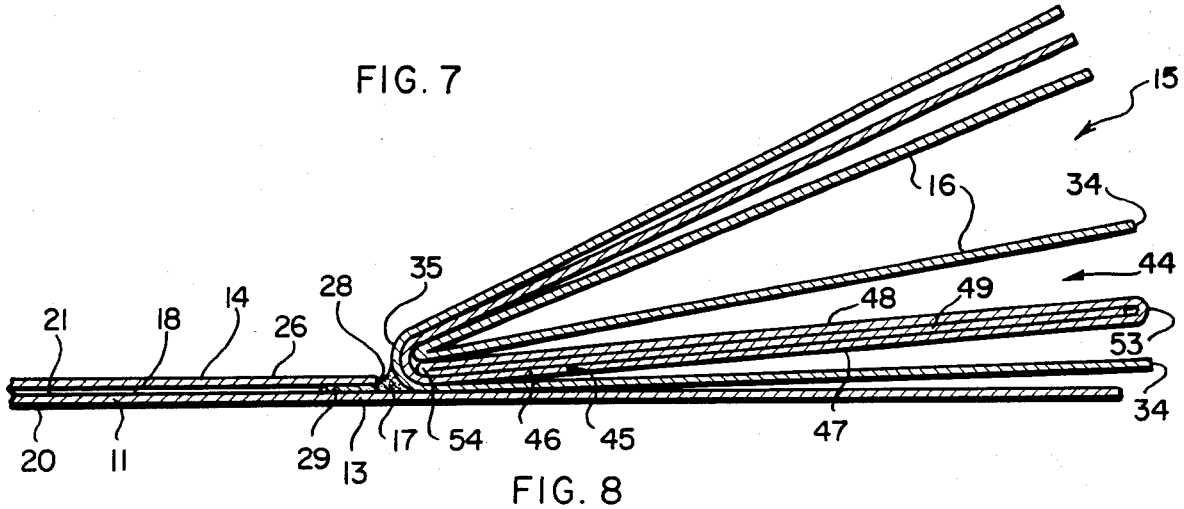
FIG. 7 is a fragmentary sectional view, similar to FIG. 5, and illustrating an embodiment housing an envelope attached to one of the booklet pages.
Figure 8:
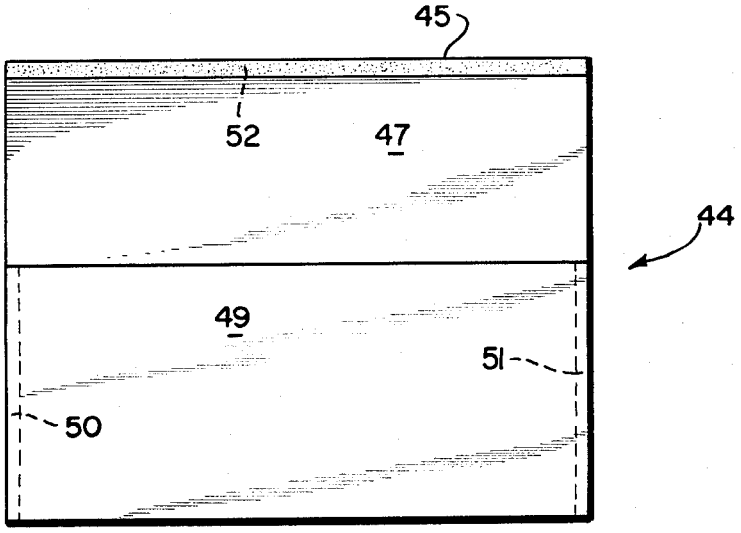
FIG. 8 is a plan view of the envelope detached from the booklet.

FIGS. 7 and 8 illustrate another embodiment of an article in accordance with the present invention. In this embodiment, the article includes, as part of the booklet 15, an envelope indicated generally at 44. More particularly, the booklet includes a page 46 from which may be detached, at a longitudinally extending tear line 45, the flap 47 of envelope 44. Envelope flap 47 is connected at a fold 53 to the back 48 of an envelope pouch in turn connected at a fold 54 to the front 49 of the envelope pouch. Pouch front 49 is secured to pouch back 48 along their lateral edge portions by adhesive strips 50, 51. Located along a longitudinal edge portion of envelope flap 47, adjacent tear line 45, is a wettable adhesive strip 52 for sealing the envelope. When envelope 44 is attached to booklet 15, it is normally in the folded condition illustrated in FIG. 7 wherein fold 53 extends no further laterally than do the longitudinal edge portions 34, 34 of pages 16, 16 in booklet 15. Part of page 46 remains with the booklet when envelope 44 is detached therefrom, and part of page 46 forms part of envelope 44.

The longitudinal dimensions of envelope 44, when it is in the folded condition in the booklet, are the same as the longitudinal dimensions of pages 16, 16 in booklet 15, and the lateral dimensions of envelope 44, when it is in the folded condition in the booklet, are the same as the lateral dimensions of pages 16, 16 in the booklet.

As noted above, the invention comprises the combination of (a) a key holder, defined by covers 11, 12 and pocket member 14, and (b) a booklet, with envelope 44 being optional. A subcombination of that invention would comprise front and back covers 11, 12 and booklet 15, with envelope 44 optional to that subcombination.

The foregoing detailed description has been given for clearness of understanding only, and no unnecessary limitations should be understood therefrom, as modifications will be obvious to those skilled in the art.

We claim:

1. An article of manufacture comprising:

a pair of covers joined together along a junction;

pocket means comprising a pocket member, attached to one of said covers, for holding a key;

said pair of covers and said pocket member having lateral and longitudinal dimensions;

the lateral dimension of each cover and of said pocket member being constant along the entire length thereof;

said one cover having a first longitudinal edge portion at the junction with the other cover and a second longitudinal edge portion remote from said junction;

a lateral slit in said one cover communicating with the interior of said pocket means;

said pocket member and said one cover each having corresponding first lateral edge portions secured together and respective second lateral edge portions remote from said first lateral edge portions;

said pocket member having a first longitudinal edge portion adhered to said one cover along the first longitudinal edge portion of the one cover, between the pocket member's first and second lateral edge portions, at least as far as said lateral slit;

said pocket member having a second longitudinal edge portion joined to the one cover at the second longitudinal edge portion of the one cover;

said lateral slit being closer to said secured first lateral edge portions of the pocket member and the one cover than to said second lateral edge portion of the pocket member.

2. An article as recited in claim 1 wherein:

said pocket member has a lateral dimension constant along the entire length thereof and substantially the same as the lateral dimension of the one cover.

3. An article of manufacture as recited in claim 1 and comprising:

a booklet comprising a plurality of pages;

said booklet being located between said covers;

means attaching said booklet to at least one of said pair of covers;

said booklet having lateral and longitudinal dimensions;

the lateral dimension of said one cover being different then the lateral dimension of said booklet along substantially the entire length of each to facilitate thumbing readily of said one cover without obstruction by said booklet.

4. An article of manufacture as recited in claim 3 wherein:

the lateral dimension of the other cover is different than the lateral dimension of said one cover to facilitate thumbing readily of said other cover without obstruction by said booklet and to facilitate thumbing readily of either of said covers without obstruction by another cover.

5. An article of manufacture as recited in claim 3 wherein said booklet comprises:

detachable envelope means connected to one of said booklet pages, said one page forming a part of said envelope.

6. An article of manufacture as recited in claim 5 wherein:

said envelope has lateral and longitudinal dimensions;

the longitudinal dimensions of both covers, of said booklet pages, of said envelope means and of said pocket means being the same.

7. An article of manufacture as recited in claim 1 wherein:

said respective second lateral edge portions of the one cover and the pocket member are unsecured.

8. An article of manufacture as recited in claim 1 wherein:

said respective second lateral edge portions of the one cover and the pocket member are secured together.

9. An article of manufacture as recited in claim 1 wherein:

said pocket member is longitudinally coextensive with said one cover.

10. An article of manufacture as recited in claim 9 wherein:

said pocket member has a lateral dimension constant along the entire length thereof and substantially the same as the lateral dimension of the one cover.

* * * * *